United States Patent [19]

Bull et al.

[11] Patent Number: 4,651,538

[45] Date of Patent: Mar. 24, 1987

[54] BEVERAGE COOLER HAVING A COLD PLATE AND PLASTIC ICE BIN

[75] Inventors: Ronald E. Bull; Kenneth W. Schneider, both of Mason City, Iowa

[73] Assignee: Schneider Metal Manufacturing Co., Mason City, Iowa

[21] Appl. No.: 773,478

[22] Filed: Sep. 6, 1985

[51] Int. Cl.[4] ..... B67D 5/62

[52] U.S. Cl. ..... 62/398; 62/399; 62/400; 62/464; 222/146.6

[58] Field of Search ..... 62/396–400, 62/464, 463, 459; 222/146 C, 240

[56] References Cited

U.S. PATENT DOCUMENTS

| | | | |
|---|---|---|---|
| 1,372,135 | 3/1921 | Green | 62/398 |
| 1,943,938 | 1/1934 | Haydel | 62/398 X |
| 1,987,810 | 1/1935 | White | 62/398 |
| 2,038,171 | 4/1936 | Gudmundsen | 62/399 X |
| 2,673,005 | 3/1954 | Brown | 62/339 X |
| 3,308,636 | 3/1967 | Schaaf | 62/464 X |
| 3,309,886 | 3/1967 | Welty | 62/339 X |
| 3,331,536 | 7/1967 | Lorenzo | 62/464 X |
| 3,605,430 | 9/1971 | Conti | 62/400 X |

*Primary Examiner*—Lloyd L. King
*Attorney, Agent, or Firm*—Henry C. Kovar

[57] ABSTRACT

A beverage cooler has a cold plate and a plastic ice cube bin secured to the cold plate by an adaptor which is permanently adjoined to plastic walls of the hopper. The adaptor has a tongue, a plate arm which fits into a rabbet on the cold plate, a foam flange which extends out into foam insulation and a plate flange fastened to the cold plate; the plastic hopper walls have a foot molded into the plate flange and rivets molded into the tongue. A method of manufacturing the plastic ice bin has the plastic walls being molded onto the adaptor, preferably by rotomolding using polyethylene as the material. A beverage cooler construction has a rotomolded exterior shell fastened to the plastic ice hopper by a spacer and top molding and has insulated beverage outlet lines which exit the shell through an offset under the molding rim. The beverage cooler has a structure which meets all sanitation codes, which is reliable, which has a long expected life, which is sanitary, and which can be manufactured by the rotomolding process.

21 Claims, 5 Drawing Figures

BEVERAGE COOLER HAVING A COLD PLATE AND PLASTIC ICE BIN

BACKGROUND OF THE INVENTION

1. Field of the Invention

This invention pertains to an improved beverage cooler having a cold plate and a plastic ice cube hopper, to a plastic ice cube hopper for securement to a cold plate, to an adaptor for securement of a plastic ice cube hopper to a cold plate, and to a method of manufacturing a plastic ice cube hopper for securement to a cold plate.

2. The Prior Art

Ice cooled beverage coolers having cold plates at the bottom of an ice hopper are old and used extensively in the retailing of dispensed soft drinks and beer in fast food establishments, bars, concession stands, and the like. Reasons for the popularity of this type of dispenser are firstly it is extremely reliable because it does not have an electromechanical refrigeration system, secondly it is relatively low cost compared to an electromechanical refrigeration system, thirdly you can get enormous cooling capacity by throwing on more ice, fourthly it does not add a heat load in the retail facility, fifth it does not require electricity, sixth it is easily portable, and so on. There are many good and valid reasons for the historic popularity of this type of dispenser.

There are many problems with past and present examples of this type of beverage cooler.

It sounds deceptively easily; why not make a plastic bucket and set the cold plate in the bottom of the bucket? It does not work because of entrapment under the plate, growth of mold and fungus, problems of getting beverage lines to and from the cold plate, and other serious sanitation problems.

The most successful construction practice has been and is to fabricate a metal outer shell, a metal inner shell and to seal the inner metal shell to the cold plate with silicone. Examples of this construction are commonplace in the fast food retailers.

There are still problems, including galvanic corrosion between dissimilar metals, rust and oxidation, leakage of seals, fungus and mold, crevices which are difficult to clean, cleanliness, odors, condensate in the insulation, failure of seals, excessive cost of construction due to the requirement for costly materials and skilled fabrication and assembly together with a requirement for high manhours and the resultant low production.

The sanitation codes posed by NSF also present a problem because only two materials can be used, specifically the cold plate material which historically is aluminum, and the hopper wall material which historically is a metal. Third materials for seals and fillets are not allowed because of de-lamination and leakage problems.

As of this date, no party has devised a successful plastic ice cube hopper for a cold plate, nor the manufacturing techniques to make such a structure.

OBJECTS OF THE INVENTION

It is an object of the present invention to provide an improved beverage cooler having a cold plate and a plastic ice cube hopper which is securely and sanitarily combined with the cold plate.

It is an object of the present invention to provide an ice cube hopper having plastic walls and which can be economically, reliably, and sanitarily combined with a beverage cooling cold plate.

It is an object of the present invention to provide a new adaptor for economical, reliable and sanitary connection of a plastic ice cube hopper to a beverage cooling cold plate.

It is an object of the present invention to provide a new method of manufacturing an ice cube hopper having plastic walls and which can be economically, reliably and sanitarily combined with a beverage cooling cold plate.

It is an object of the present invention to provide a new method of manufacturing a beverage cooler having a cold plate and plastic ice cube hopper walls.

It is an object of the present invention to provide an improved beverage cooler having an improved construction and which is more sanitary.

These and other objects of the present invention will become manifest to those versed in the art upon review of the teachings herein.

SUMMARY OF THE INVENTION

A beverage cooler has a cold plate heat exchanger, a tubular plastic ice cube hopper having plastic walls extending upward from the cold plate, a structural adaptor permanently adjoined to the plastic walls, structure securing the adaptor to the cold plate, and structure sealing the adaptor to the cold plate.

An ice cube hopper for securement to a cold plate has a tubular plastic hopper with plastic walls and a structural adaptor for connection of the hopper to a cold plate, the adaptor has a tongue permanently adjoined to the plastic walls, structure for securing and sealing the adaptor to a cold plate, and structure smoothly blending the plastic walls into a flat upper surface which will be co-planar with a cold plate.

An adaptor for sanitary connection of a plastic ice cube hopper to a cold plate has a plate flange for securement to a cold plate, a tongue having structure for permanent adjoinment to the plastic hopper, a plate arm which extends to a first side of the adaptor, and a foam arm on an opposite side of the adaptor from the plate arm.

A method of manufacturing a plastic ice cube hopper, which is securable to a cold plate for cooling beverages, has the steps of fabricating a structural adaptor and providing features for positive securement to a plastic hopper, securement to a cold plate and sealing to a cold plate, and molding a tubular plastic hopper while securing and sealing the adaptor to the plastic hopper, and forming a smooth internal radius between plastic walls and the adaptor for subsequent smooth blending into an upper surface of the cold plate.

DESCRIPTION OF THE PREFERRED EMBODIMENT

Figure 1:
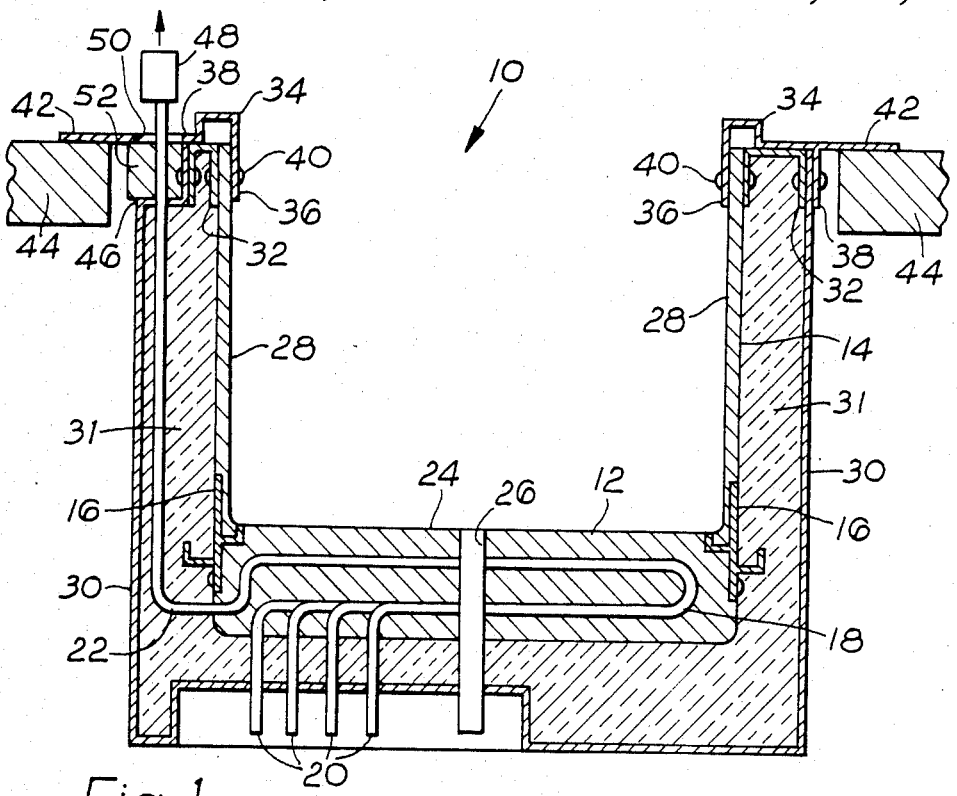
FIG. 1 is an elevational cross-sectioned view of the preferred embodiment of a beverage cooler according to the present invention.

The principles of the present invention are particularly useful when embodied in a beverage cooler such as is shown in FIG. 1 and which is generally indicated by the numeral 10. The cooler 10 uses ice as the cooling medium and has a cold plate 12, a plastic ice cube hopper 14, and an adaptor 16 which permanently and sanitarily secures the cold plate 12 to the hopper 14.

The cold plate 12 is made of a casting of relatively pure and high heat transfer aluminum. The cold plate 12 has embedded coils 18 each of which has an inlet 20 and an outlet 22 for beverages. The cold plate 12 has a generally planar top surface 24 and a drain 26 for melted water from ice cubes.

The plastic ice cube hopper 14 has vertical plastic walls 28 and the preferred material for the hopper 14 is low density polyethylene (LDP). The outer shell 30 of the dispenser 10 is preferably rotational molded linear low density polyethylene (LLDP). Between the connected hopper 14 and cold plate 12, and the outer shell 30 is foamed in place polyurethane insulation 31. A structural spacer 32 is in between the hopper 14 and the shell 30 and the top molding 34 has an inner flange 36 and an outer flange 38 which are held permanently by rivets 40 to the hopper 14, shell 30, and spacer 32. A molding rim 42 supports the dispenser 10 in a countertop 44.

The beverage coil outlets 22 extend outward and upward and are encased in the insulation 31. The shell 30 has an inward dogleg 46 provided underneath the molding rim 42 outside of the outer flange 38. The dogleg 46 enables usage of an identical section top molding 34 on all four sides of the dispenser 10 and enables riveting of the outer flange 38 to the shell 30 behind and under the outlet fittings 48 which extend through an aperture 50 in the molding rim 34. The exposed length of outlet coil 22 is enclosed within thermally insulating foam collars 52. The outlet fittings 48 are fluidly connected to beverage dispensing valves (not shown).

Figure 2:
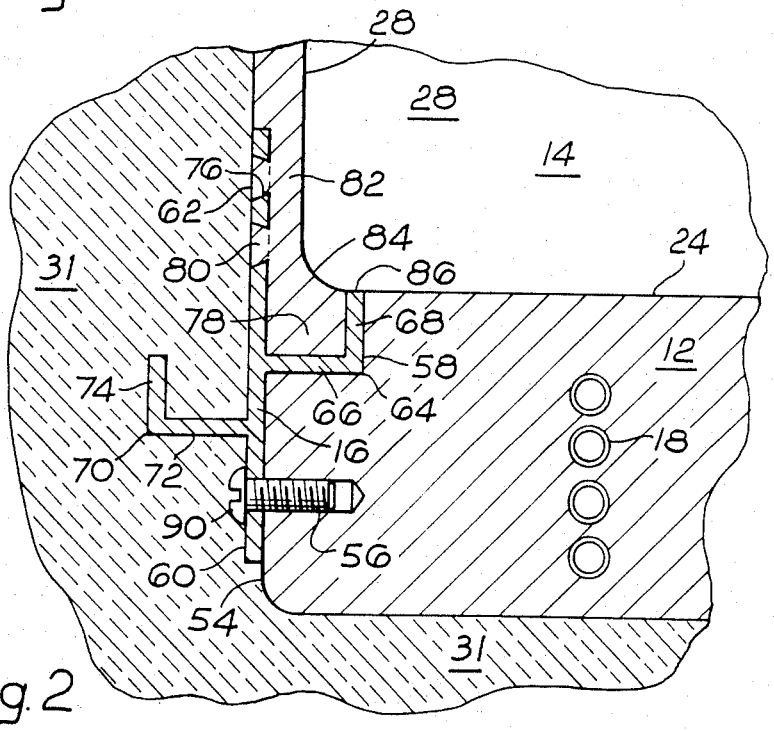
FIG. 2 is an elevational cross-sectioned view, in magnified detail, of the structure securing the plastic ice cube hopper to the cold plate, as utilized in FIG. 1.

FIG. 2 best illustrates in detail the permanent, reliable and sanitary structural connection of the plastic hopper 14 to the cold plate 12. The cold plate 12 has outer peripheral surfaces 54 with bored fastener holes 56, and a concave rabbet 58 around the top corner of the cold plate 12. The rabbit 58 extends around the entire periphery 54 of the cold plate 12. The adaptor 16 has a cross section that looks like a two-armed cactus. There is a plate flange 60 on the bottom, and a tongue 62 which is on top of and which extends upward from the plate flange 60. An L-shaped plate arm 64 is in between the plate flange 60 and the tongue 62 and has an inner arm 66 which extends generally perpendicularly outward from the tongue 62 and plate flange 60, and an upward extending outer arm 68 which is generally parallel to and which extends alongside the tongue 62. An L-shaped foam arm 70 is in between the tongue 62 and plate flange 60 and is on an opposite side from the plate arm 64. The foam arm 70 has an outward extending inner arm 72 and an upward extending outer arm 78 which is generally parallel to and alongside of the tongue 62. The tongue 62 has a staggered and repetitive set of rivet receivers 76. The hopper 14 is permanently secured to the adaptor 16. Each hopper wall 28 has a foot 78 in the plate arm 64 and rivets 80 in the receivers 76. The hopper walls 28 are positively secured in and held by the adaptor 16 and the walls 28 cannot move up, down, sideways or endways. The hopper wall 28 has an inner bottom leg 82 which carries the rivets 80 and which has a generous concave fillet 84 which smoothly blends to the level of the head 86 of the plate outer arm 68. The arm head 86 and the bottom and inside of the fillet 84 are flush with and co-planar with the cold plate top surface 24.

Figure 3:
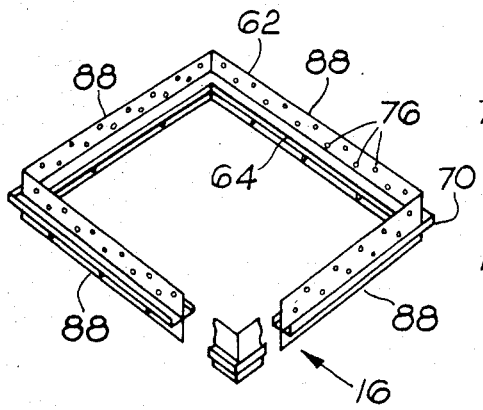
FIG. 3 is a perspective view of the adaptor used in the structure of FIGS. 1 and 2.

FIG. 3 shows a complete and discrete adaptor 16. The adaptor 16 typically has four sides 88 because cold plates 12 are usually four sided. Each adaptor side 88 has ends which are mitered and which have been precisely fitted together and welded together. The adaptor 16 is fabricated so that the plate outer arm 68 has a clearance in the rabbet 58 in the range of zero to 0.03 inch (0.75 mm) cumulative for opposite sides. When the hopper 14 with the adaptor 16 secured thereto is fitted to the cold plate 12, a bead of silicone sealant is laid down in the rabbet 58 and the plate arm 64 is pushed into the rabbet 58 and a plurality of fasteners 90 are driven through the plate flange 60 and into the peripheral holes 56 which permanently secures the hopper 14 to the cold plate 12; the plastic walls 28 are held to the cold plate 12 by the adaptor 16.

Figure 4:
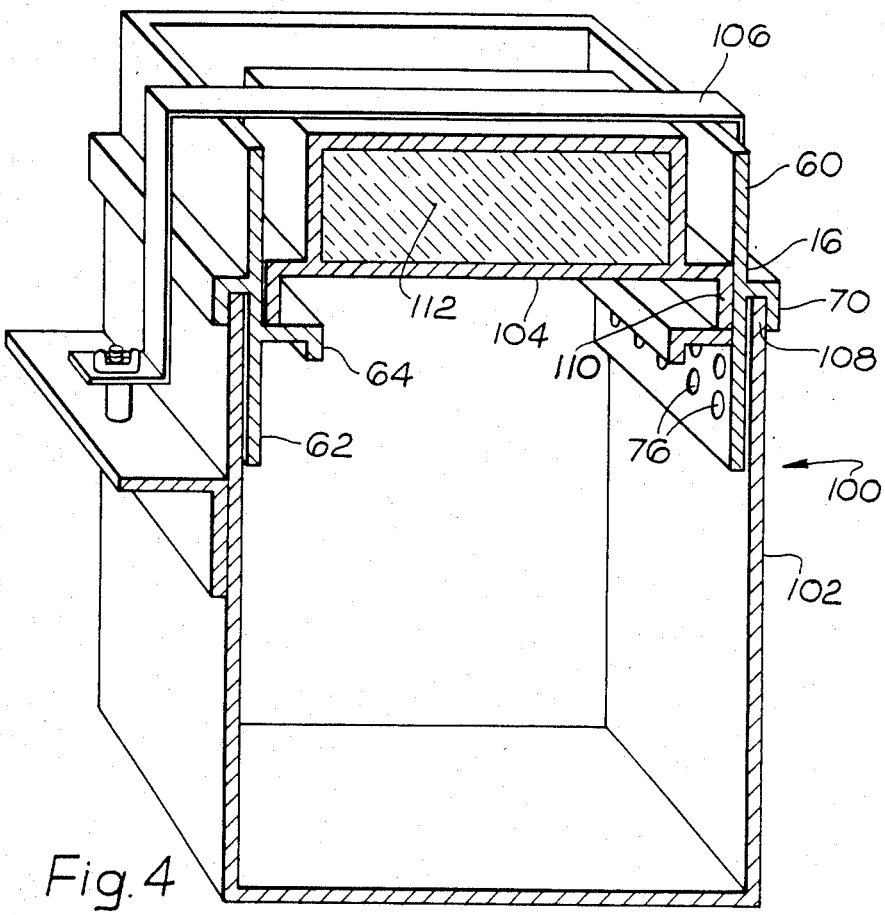
FIG. 4 is a cross-sectioned elevational view illustrating the manufacture of the structure of FIG. 1 and the practice of the method of the present invention.
Figure 5:
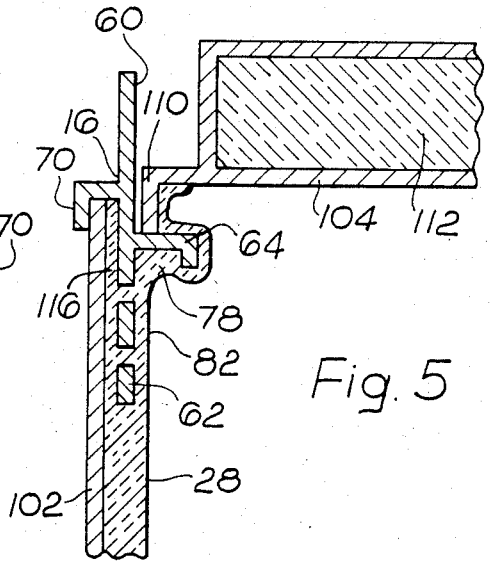
FIG. 5 is a cross-sectioned elevational detail of the adaptor and plastic hopper section before removal from the mold and subsequent trimming of excess plastic.

The method of manufacturing the plastic ice hopper 14 can best be explained with referral to FIGS. 4 and 5. FIG. 4 shows the unique mold 100 and FIG. 5 shows a section of the molded wall 28 before removal from the mold 100. The mold 100 is a rotational plastic casting mold 100. The mold 100 has three basic components, the tub 102 within which the hopper walls 28 are formed, a cap 104 which holds the adaptor 16 in and to the mold 100, and a closing lock 106 which holds the cap 104, adaptor 16 and tub 102 together after the mold 100 has been loaded with plastic powder and as the mold 100 is rotated through the conventional and well known roto-casting process wherein the mold is rotated on three axis in a hot air oven until the plastic powder melts on the inside surfaces of the heated mold and forms the plastic part. The tub 102 has an upper lip 108 which fits in the foam flange 70 and which bottoms against the foam arm inner arm 72. The cap 104 has a lip 110 which abuts against the inner arm 66 of the plate arm 64 to positively hold the adaptor 16 in place in the mold 100 with the tongue 62 and plate arm 64 being inside the mold 100 and the foam arm 70 and plate flange 60 are outside of the mold 100. The cap 104 has an insulated center section 112 so that the cap center 114 does not get warm enough to form a plastic wall. The insulated center section 112 is spaced inward from the adaptor plate flange 60 so that hot air has a clear path to both sides of the plate flange 60 as well as the outside of the foam arm 60. The adaptor 16 is preferably an aluminum extrusion that has been surface treated for relatively high adhesion. The area of the adaptor 16 which is outside of the mold 100 is sufficient to completely heat the adaptor 16 so that powder inside the mold 100 melts on the adaptor 16 to form the foot 78, fillet 84, inside bottom leg 82 and rivets 80. The tub 102 gets hot and forms the plastic hopper walls 28.

When the mold 100 and adaptor 16 are constructed as shown in FIG. 4 with the tub lip 108 being against the adaptor tongue 62, the structure shown in FIG. 2 with only an inner bottom leg 82 will be molded. If the mold 100 and adaptor 16 are constructed as shown in FIG. 5 with the tub lip 108 spaced outward from the adaptor tongue 62, an outer bottom leg 116 will be molded and the tongue 62 will be completely imbedded in the plastic walls 28 with the rivets 80 running through the tongue 62 and being integral with both the inner leg 82 and the outer leg 116. Regardless, the plastic walls 28 are positively and permanently secured to the adaptor 16.

When the hopper 14 is removed from the mold 100, a trim operation is necessary to remove excess plastic from the plate outer arm 68, the plate lower arm 66 and to blend the fillet 84 to the plate arm head 86. This has been found to be a simple and economical operation with either a router and/or a trim knife.

When the assembly and foaming of the beverage cooler 10 is done, the foam 31 flows into and fills the foam arm 70. Thus the foam 31 holds the cold plate 12 down in the cooler 10 so that the cold plate 12 does not de-laminate from the foam 31 and tend to eventually de-laminate the plastic walls 28 from the foam 31. The foam arm 70 also holds the foam 31 positively against the outside of the plastic hopper walls 28 so that the walls 28 are backed up and do not seem to be flimsy. In the construction of FIG. 5 the foam 31 also positively retains the outer bottom leg 116 against the tongue 62.

The structure of the beverage cooler 10 is extremely solid, reliable, sanitary, and it meets and exceeds all known sanitation standards. The manufacturing methods enable the economical manufacture of what is thought to be the first successful combination of a plastic hopper 14 to a cold plate 12. The aluminum cold plate 12 and aluminum adaptor 16 have the same thermal expansion co-efficient and there is never a loss of the fluid tight seal between the cold plate 12 and the adaptor 16. The plastic walls 28 can never de-laminate or come loose on the adaptor 16. The plastic hopper 14 can now be successfully molded; it has been found economically impossible to mold it directly upon the cold plate 12 because the cold plate 12 cannot be warmed and cooled as required to make the rotomolding process work. The usage of the adaptor 16 even makes injection molding of the hopper 14 feasible.

Although other advantages may be found and realized, and various and minor modifications suggested by those versed in the art, be it understood that we wish to embody within the scope of the patent warranted hereon, all such embodiments as reasonably and properly come within the scope of our contribution to the art.

We claim as our invention:

1. An improved beverage cooler, comprising (a) a cast aluminum cold plate heat exchanger:

(b) a tubular plastic ice cube hopper having an open top and bottom and thermo plastic walls extending upwardly from the plate, said walls and said plate jointly defining a bin having a closed bottom for holding ice cubes upon the top of the plate;

(c) a rigid materially discrete structural adaptor around the bottom of the hopper and having a portion permanently adjoined and sealed to the bottom of the plastic walls;

(d) fasteners securing the adaptor to the cold plate; and (e) sealing means between the adaptor and the cold plate for fluidly tightly sealing the adaptor to the cold plate.

2. An improved ice cube hopper for securement to a cold plate, comprising (a) an open ended tubular plastic hopper having plastic walls for forming the upright sides of the ice cube bin; and (b) a rigid materially discrete structural adaptor around one end of the hopper for permanent and sanitary connection of the hopper to a cold plate, said adaptor having (1) a tongue permanently adjoined and sealed to the plastic walls, (2) means below the tongue for securement of the adaptor to the cold plate, (3) means for fluid tightly sealing the adaptor to the cold plate, and (4) means for smoothly blending the plastic walls into a flat upper surface which will be generally co-planar with an upper surface of the cold plate when said hopper is mounted and secured to the cold plate.

3. A rigid adaptor for sanitary connection of a thermo plastic ice cube hopper to a cast aluminum cold plate, comprising (a) a plate flange for securement to a peripheral side of the cold plate;

(b) a tongue extending above and from the plate flange, said tongue being permanently adjoinable into the plastic hopper and having means for positive up-down and fore-aft locations and securement of the plastic hopper to the adaptor;

(c) an L-shaped plate arm in between the tongue and the plate flange, said arm having an inner arm extending generally outward from the tongue and an upward extending outer arm which is spaced from and is generally alongside of the tongue; and (d) a foam arm in between the tongue and the plate flange, said foam arm being on an opposite side of the adaptor from the plate arm.

4. An improved beverage cooler, comprising (a) a cast aluminum cold plate;

(b) a tubular open ended thermo plastic ice cube hopper having an open bottom end permanently and sanitarily secured to a peripheral surface of the cold plate;

(c) a thermo plastic exterior shell spaced from and not in contact with the cold plate;

(d) foamed-in-place thermal insulation between the shell and the cold plate-ice cube hopper; and (e) a rigid structural top molding on the hopper and the shell; said molding having (1) an outer flange permanently secured to the shell, (2) an inner flange permanently secured to the inside of a top end of the hopper, and (3) a peripheral rim extending outward beyond the shell and the outer flange, said cooler being supportable in a countertop by said rim.

5. The beverage cooler of claim 1, in which the cold plate has a rabbet on its upper outer edge, the adaptor has a plate arm in and sealed to the rabbet, and the adaptor has an upright tongue above the plate arm to which the plastic walls are permanently adjoined.

6. The beverage cooler of claim 1, in which both the cold plate and the adaptor are aluminum.

7. The beverage cooler of claim 5, in which the plastic walls have a foot in the plate arm and an inner bottom leg on the tongue.

8. The beverage cooler of claim 7, including a smooth fillet between the bottom leg and the foot.

9. The beverage cooler of claim 8, in which the fillet is flush with a top surface of the cold plate.

10. The ice cube hopper of claim 2, in which the plastic hopper is contiguous, and the adaptor is a continuous ring to which the plastic hopper is adjoined.

11. The ice cube hopper of claim 10, in which the adaptor is four lengths of aluminum extrusion which have their ends mitered and fastened together to form the ring.

12. The ice cube hopper of claim 2, in which the tongue is embedded in the plastic walls of the hopper.

13. The ice cube hopper of claim 2, in which the sealing means include a plate arm, and the blending means include a plastic fillet above a plastic foot in the plate arm.

14. The adaptor of claim 3, in which it is an aluminum extrusion having a cactus-shaped cross-section.

15. The adaptor of claim 3, in which tongue securement means are a staggered row of rivet receivers.

16. The adaptor of claim 3, including means in the plate arm for receiving a plastic foot therein.

17. The adaptor of claim 3, including means in the foam arm for positively holding foam in both up-down and lateral directions.

18. The beverage cooler of claim 4, including an adaptor in between the cold plate and the plastic hopper, said adaptor being positively fixed and secured in shear to both the cold plate and the plastic hopper.

19. The beverage cooler of claim 4, including cold plate beverage outlet lines buried in the foam insulation, and a outward dogleg in the shell underneath and spaced below the rim of the top molding on one side of the cooler, said outlet lines exiting upwardly from the shell and insulation through the dogleg.

20. The beverage cooler of claim 1, in which the thermo plastic hopper has been rotomolded to the adaptor.

21. The hopper of claim 2, in which the thermo plastic walls have been rotomolded onto the adaptor.

* * * * *